US006802905B2

(12) United States Patent
Sohn et al.

(10) Patent No.: US 6,802,905 B2
(45) Date of Patent: Oct. 12, 2004

(54) MANUFACTURING APPARATUS FOR PLASMA DISPLAY PANEL

(75) Inventors: Ji-Hoon Sohn, Gyungki-Do (KR); Eun-A Moon, Seoul (KR); Bum-Jin Bae, Seoul (KR); Young-Jae Cho, Seoul (KR); Byung-Gil Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/285,837

(22) Filed: Nov. 1, 2002

(65) Prior Publication Data

US 2003/0101930 A1 Jun. 5, 2003

(30) Foreign Application Priority Data

Nov. 30, 2001 (KR) ..... 2001-75512

(51) Int. Cl.[7] ..... B05C 11/00; B05B 15/02; B05B 7/00; H01J 9/227

(52) U.S. Cl. ..... 118/668; 118/713; 118/302; 118/313

(58) Field of Search ..... 118/668, 712, 118/713, 313, 302, 58, 66

(56) References Cited

U.S. PATENT DOCUMENTS 6,146,567 A * 11/2000 Sachs et al. ..... 118/313
6,152,030 A * 11/2000 Fuqua ..... 101/115
6,210,481 B1 * 4/2001 Sakai et al. ..... 118/697
2002/0070102 A1 * 6/2002 Kawada et al. ..... 198/817
2003/0076609 A1 * 4/2003 Kawase ..... 359/885

FOREIGN PATENT DOCUMENTS

JP 11-073882 3/1999 ..... H01J/9/227
JP 11-300257 11/1999 ..... B05C/5/02

* cited by examiner

*Primary Examiner*—J. A. Lorengo
*Assistant Examiner*—Y. T. Tadesse
(74) *Attorney, Agent, or Firm*—Lee, Hong, Degerman, Kang & Schmadeka

(57) ABSTRACT

Disclosed is a manufacturing apparatus for a plasma display panel (PDP) to form a fluorescent material film in the PDP, the apparatus comprising a lower table; a lower rail formed on the lower table; a panel mounting portion operated on the lower rail for mounting a panel detachably; an upper fixation plate installed above the lower table; and a plurality of fluorescent material ink spread units fixed to the upper fixation plate and having a plurality of nozzle holes corresponding to non-applied rows for forming fluorescent material on the fluorescent material film of the panel, wherein a sophisticated spread of the fluorescent material is performed more efficiently.

5 Claims, 2 Drawing Sheets

MANUFACTURING APPARATUS FOR PLASMA DISPLAY PANEL

BACKGROUND OF THE INVENTION

1. Field of the Invention

The present invention relates to a plasma display panel (PDP), and particularly, to a manufacturing apparatus for a plasma display panel, in which fluorescent material ink is spread more efficiently.

2. Description of the Background Art

Among display apparatuses for information, a cathode ray tube (CRT) called as a brown tube occupies most of rates.

The CRT which has been widely used as a display apparatus of a television has an excellent resolution and picture quality. However, a weight of the CRT is increased according to a size of a screen, so that the CRT is not proper in a big screen more than 40 inches.

Since a demand for a large type display device and a television of a high resolution is increased, a flat plasma display (FPD) of a full-color having a thin thickness, a light weight, a high brightness, a high efficiency, a high resolution, a fast response characteristic, a high length, a low driving voltage, a low consumption power, and a low price is required to be developed instead of the CRT which is heavy and large.

The full color flat plasma display (FDP) currently being developed includes a liquid crystal display (LCD), an electro-luminescent display (ELD), a field emitter display (FED), and etc.

Even if the LCD has an excellent performance such as a low consumption power and a lower driving voltage, it has a technical difficulty in manufacturing a large screen.

Currently, with many efforts to realize the apparatuses having a high performance and a low price, a process of a low price which will substitute the conventional screen print method and a photolithography process is continuously being developed.

The PDP can shorten an inner length and at the same time realize a large screen. A large type screen of 50 inches is already being developed.

The PDP is divided into a direct current (DC) type and an alternating current (AC) type, in which the AC type takes the main stream.

An AC surface discharge PDP which is representative as the AC type generally includes a frontal panel on which a display electrode is arranged, and a back panel on which an address electrode is arranged. The two electrodes are arranged in parallel as a matrix form, and an interval between the two panels is divided into diaphragms of a stripe shape.

Also, a fluorescent material layer of green, red, and blue is formed between the diaphragms, and discharge gas is filled. If the discharge gas is discharged by applying a voltage to each electrode, ultraviolet rays is emitted. According to this, the fluorescent material element (R,G,B) of the fluorescent material layer receives the ultraviolet rays and excited and luminescent, thereby displaying a screen.

The PDP is arranged at the diaphragms on the back panel, and the fluorescent material layer is formed between the diaphragms. The front panel is overlapped on the fluorescent material layer and the discharge gas is filled.

A method for forming the fluorescent material layer between the diaphragms includes a screen printing method, a photo resist film method, and an ink-jet method.

The screen printing method has a difficulty in applying to the PDP of a sophisticated cell structure, and the photo resist film method has a problem that a manufacturing process is complicate and a color mixture is easily generated.

Comparing with them, the ink-jet method has been widely used by solving said problems. In the ink-jet method, a pressure is applied to ink liquid composed of a fluorescent material and an organic binder, and the ink is injected from the nozzle hole, thereby attaching the fluorescent material ink on an insulator plate as a desired pattern.

However, the conventional ink-jet method has a problem that ink is not sophisticatedly spread in case that the nozzle hole (not shown) of the fluorescent material ink spread unit is blocked or contaminated.

Also, in case that the ink spread unit is operated on the panel so as to spread the fluorescent material ink, uneven spread can be caused by slopping of the ink.

In addition, in the ink-jet method, it is not efficient to spread the fluorescent material ink on many non-applied rows formed on the back panel by a spread unit having a small number of nozzles and an error generation rate is increased.

SUMMARY OF THE INVENTION

Therefore, an object of the present invention is to provide a manufacturing apparatus for PDP, in which fluorescent material ink is spread sophisticatedly and more efficiently.

To achieve these and other advantages and in accordance with the purpose of the present invention, as embodied and broadly described herein, there is provided a fluorescent material ink spread unit comprising: a lower table; a lower rail formed on the lower table; a panel mounting portion operated on the lower rail for mounting a panel detachably; an upper fixation plate installed above the lower table; and a plurality of fluorescent material ink spread units fixed to the upper fixation plate and having a plurality of nozzle holes corresponding to non-applied rows for forming fluorescent material on the fluorescent material film of the panel.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
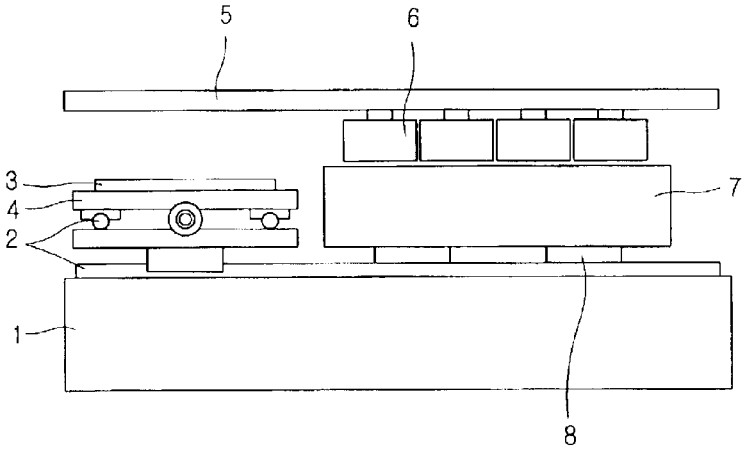
FIG. 1 is a sectional view showing a structure that a fluorescent material ink spread unit and its washing unit are mounted according to the present invention.

FIG. 1 is a sectional view showing a structure that a fluorescent material ink spread unit and its washing unit are mounted according to the present invention.

The fluorescent material ink spread unit according to the present invention, in a manufacturing apparatus for PDP which forms a fluorescent material film in the PDP, includes a lower table 1; a lower rail 2 formed on the lower rail 2; a panel mounting portion 4 operated on the lower rail 2 for mounting a panel 3 detachably; an upper fixation plate 5 installed at an upper portion of the lower table 1; and a plurality of fluorescent material ink spread units 6 fixed to the upper fixation plate 5 and having a plurality of nozzle holes corresponding to non-applied rows 31 for forming fluorescent material on the fluorescent material film of the panel 3.

The washing unit of the fluorescent material ink spread unit according to the present invention is formed at one side of the panel mounting portion 4 and includes a nozzle hole washing unit mounting portion 8; and a nozzle hole washing unit 7 mounted at an upper portion of the nozzle hole washing unit mounting portion 8 for washing the nozzle holes 61.

The fluorescent material ink spread unit and its washing unit according to the present invention will be explained with reference to FIG. 2.

Figure 2:
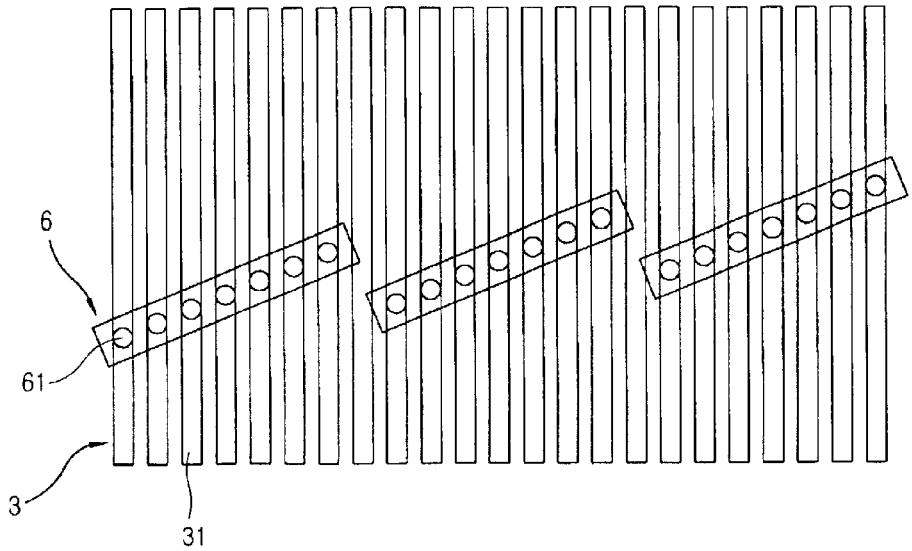
FIG. 2 is a conceptual view showing a nozzle location of a fluorescent material ink spread unit respectively corresponding to non-applied rows of respective panels.

FIG. 2 is a conceptual view showing a nozzle location of a fluorescent material ink spread unit respectively corresponding to non-applied rows of respective panels.

First of all, at an initial manufacturing process for PDP, ink is loaded to the fluorescent ink spread units 6 and a process to inject ink to all nozzle holes 61 is set by the nozzle hole washing unit 7.

At this time, the panel 3 of a non-applied object is mounted at the panel mounting portion 4 and operated on the lower table 1.

In a manufacturing process for the PDP, since not the nozzle hole washing unit 7 but the fluorescent material ink spread unit 6 moves, inferior injection can be caused by slopping of the injected ink.

However, as shown in FIG. 1, since the fluorescent material ink spread unit 6 for spreading the fluorescent material ink on the panel 3 is fixed by the upper fixation plate 5, uneven spreading due to slopping of the ink by a shake of the fluorescent material ink spread unit 6 is prevented.

Besides, at the time of manufacturing the PDP, since the fluorescent material ink spread unit 6 can be fixed or moved, and the panel mounting portion 4 supporting the panel 3 can be also fixed or moved, a plurality of the fluorescent material ink spread units 6 are installed as a wanted fluorescent material ink spread pattern, thereby performing the manufacturing process just by one flow.

Also, the PDP manufacturing apparatus is composed of a plurality of the fluorescent material ink spread units 6 including a plurality of the nozzle hoes 61, and the nozzle holes 61 are respectively corresponding to a plurality of the non-applied rows 31, thereby performing a process on the entire panel 3 just by one spread of the fluorescent ink. At this time, plural fluorescent material ink spread units 6 are provided so as to greatly reduce a processing time and its cost in the manufacturing apparatus for PDP.

Accordingly, since ink is spread to the plurality of non-applied rows by the ink spread unit having a small number of the nozzle holes at the time of manufacturing the conventional PDP, a low efficiency and a high error generation ratio can be solved.

FIG. 2 is a conceptual view showing that the fluorescent material ink spread units 6 and the plurality of nozzle holes 61 are tilted with an arbitrary angle in parallel to the panel 3 correspondingly to a wanted pattern pitch.

As shown, the units are arranged with correct intervals so as to perform the manufacturing process just by one flow.

In case that the said units are applied to a manufacturing process of a R,G,B color filter such as the PDP and the LCD, three groups of the fluorescent material ink spread unit can be attached according to each kind of the R,G,B color filter.

Figure 3:
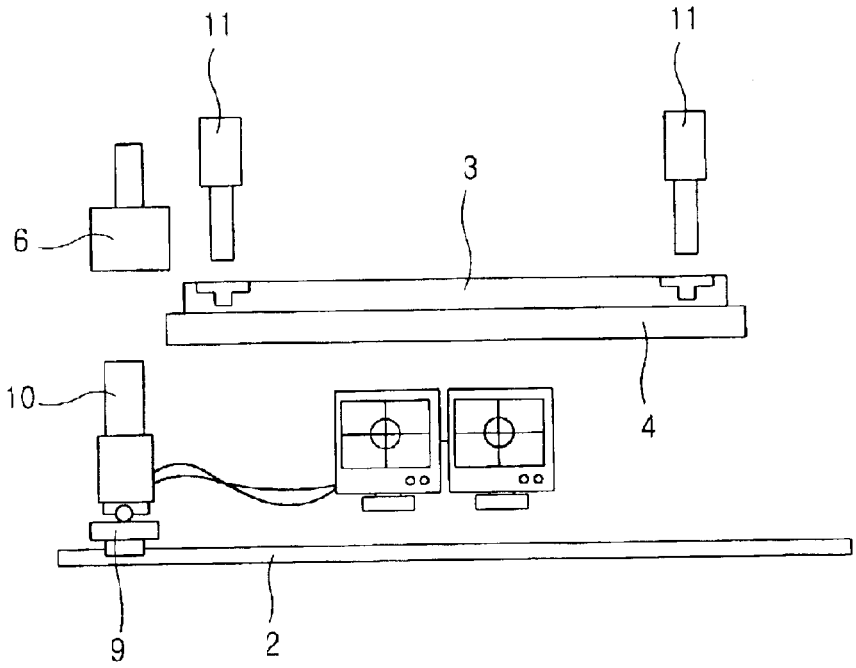
FIG. 3 is a sectional view showing a structure that a panel location identifying unit and a nozzle location identifying unit are mounted.

FIG. 3 is a sectional view showing a structure that a panel location identifying unit and a nozzle location identifying unit are mounted.

The nozzle location identifying unit according to the present invention includes a nozzle hole location identifying charge coupled device (CCD) camera mounting portion operated on the lower rail 2; and the two nozzle hole location identifying CCD cameras mounted at an upper portion of the nozzle hole location identifying CCD camera mounting portion 9.

Also, the panel location identifying unit according to the present invention is composed of a panel location identifying charge coupled device (CCD) camera 11 mounted at the upper fixation plate 5 for obtaining an image of an upper side of the panel 3 and then outputting.

Operations and performances of the units will be explained as follows.

First, if ink injection by the fluorescent material ink spread unit 6 is completed, a loading of the panel 3 is performed.

At this time, locations of the nozzle holes 61 of the fluorescent material ink spread unit 6 and the panel 3 should be correctly designated so that the panel 3 may form a correct pattern.

Accordingly, in the nozzle hole location identifying unit, as shown, the two panel location identifying CCD cameras 10 are respectively mounted to the first and last nozzle holes so as to identify locations the nozzle holes 61 for spreading the fluorescent material ink and the panel 3 among the plurality of nozzle holes 61.

That is, the two nozzle hole location identifying CCD cameras 10 mounted at the nozzle hole location identifying CCD camera mounting portion 9 designates first and last locations of the nozzle holes 61, thereby injecting ink at a correct position. Also, the cameras 10 are installed to move right and left automatically so as to identify an operation situation of the plurality of fluorescent material ink spread units 6.

The two nozzle hole location identifying CCD cameras 10, as shown, identify the fluorescent material ink spread units 6 by being installed toward an upper direction since the nozzle holes of the fluorescent material ink spread units 6 are installed toward a lower direction.

In the meantime, the two panel location identifying CCD cameras 11 mounted at the upper fixation plate 5 (not shown since it is equal to that of FIG. 1) can identify locations of the panels 3 whenever the panels 3 are consecutively loaded.

Accordingly, in the manufacturing process for PDP requiring a very sophisticated accuracy, the panel location identifying unit can identify whether the panel is correctly mounted at a predetermined position of the panel mounting portion 4 or not.

Namely, the nozzle hole location identifying unit identifies not locations of all the nozzle holes 61 but locations of the first and last nozzle holes, thereby correctly identifying whether the nozzle holes 61 corresponding to the respective non-applied rows 31 of the panel 3 correctly spread the fluorescent ink or not. According to this, it can be economical in a real process.

Figure 4:
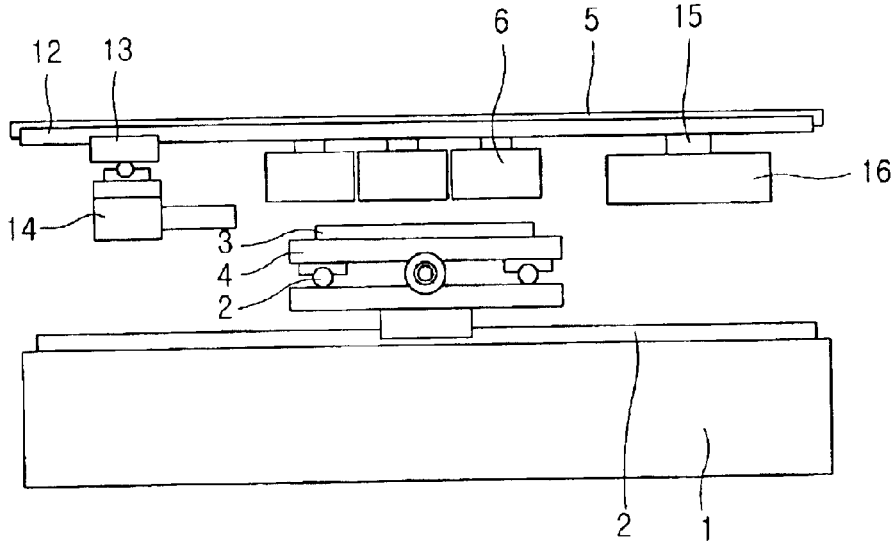
FIG. 4 is a sectional view showing a structure that a real time injection identifying unit and a drying unit are mounted.

FIG. 4 is a sectional view showing a structure that a real time injection identifying unit and a drying unit are mounted.

The real time injection identifying unit according to the present invention includes: an upper rail 12 installed at the upper fixation plate 5; a real time injection identifying CCD camera mounting portion 13 operated on the upper rail 12; and a real time injection identifying CCD camera 14 mounted below the real time injection identifying CCD camera mounting portion 13 for obtaining an image of the fluorescent material ink spread between the nozzle holes 61 and the panel 3 and then outputting.

A panel drying unit according to the present invention includes: a panel drying means mounting portion 15 fixed to the upper fixation plate 5; and a panel drying unit 16 mounted at the panel drying means mounting portion 15 for drying the panel 3 after the fluorescent material ink is spread.

Operations and performances of the units will be explained as follows.

First, if locations of the nozzle holes 61 and the panel 3 of the fluorescent material ink spread unit 6 are designated, a predetermined pattern of the panel 3 is formed by ink injected from the fluorescent material ink spread unit 6.

At this time, the panel drying unit 16 mounted at the panel drying means mounting portion 15 is used so as to obtain a yield.

Namely, the panel drying unit 16 increases the yield according to ink spread by drying the fluorescent ink spread on the non-applied rows 31 of the panel 3 after the fluorescent material ink is spread.

In the meantime, the real time injection identifying CCD camera 14 magnifies and certifies minute particles of the fluorescent material ink injected toward the non-applied rows 31 of the panel 3 from the nozzle holes 61, thereby enhancing a reliability of the manufacturing process.

As aforementioned, the manufacturing apparatus for PDP is provided with at least one or two units among the fluorescent material ink spread unit, the washing unit of the fluorescent material ink spread unit, the panel location identifying unit, the nozzle hole identifying unit, the real time injection identifying unit and the panel drying unit, and is not limited to one unit.

Also, to the manufacturing apparatus for PDP, the fluorescent material ink spread unit, the washing unit of the fluorescent material ink spread unit, the panel location identifying unit, the nozzle hole identifying unit, the real time injection identifying unit, and the panel drying unit can be all mounted, thereby performing all processes of the panel accurately and stably just by one operation.

Therefore, in the manufacturing apparatus for PDP according to the present invention, the sophisticated fluorescent material ink spread can be performed by more efficient methods.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A manufacturing apparatus for a plasma display panel (PDP) to form a fluorescent material film in the PDP, the apparatus comprising:

a lower table;

a lower rail formed on the lower table;

a panel mounting portion operated on the lower rail for detachably mounting a panel;

an upper fixation plate installed above the lower table;

a plurality of fluorescent material ink spread units fixed to the upper fixation plate, wherein the plurality of fluorescent material ink spread units comprise a plurality of nozzle holes corresponding to non-applied rows for forming fluorescent material on the PDP;

a nozzle hole location identifying CCD camera mounting portion operated above the lower rail; and two nozzle hole location identifying CCD cameras mounted at an upper portion of the nozzle hole location identifying CCD camera mounting portion, wherein the two nozzle hole location identifying CCD cameras are respectively mounted to a first and last nozzle holes of the plurality of nozzle holes so as to identify locations of first and last nozzle holes.

2. The apparatus of claim 1, further comprising:

a nozzle hole washing unit mounting portion formed at one side of the panel mounting portion and operated on the lower rail; and a nozzle hole washing unit mounted at an upper portion of the nozzle hole washing unit mounting portion for washing the nozzle holes.

3. The apparatus of claim 1, further comprising two panel location identifying charge coupled device (CCD) cameras installed at the upper fixation plate and mounted at the panel mounting portion for obtaining an image of an upper side of the panel and then outputting.

4. The apparatus of claim 1, further comprising:

an upper rail installed at the upper fixation plate;

a real time injection identifying CCD camera mounting portion operated on the upper rail; and a real time injection identifying CCD camera mounted below the real time injection identifying CCD camera mounting portion for obtaining an image of fluorescent material ink spread between the nozzle hole and the panel and outputting.

5. The apparatus of claim 1, further comprising:

a panel drying unit mounting portion fixed to the upper fixation plate; and a panel drying unit mounted at the panel drying unit mounting portion for drying the panel after the fluorescent material ink is spread.

* * * * *